US005947232A

United States Patent [19]

Traktovenko et al.

[11] Patent Number: 5,947,232

[45] Date of Patent: Sep. 7, 1999

[54] SWING ARM TO PREVENT SWAY OF ELEVATOR ROPES

[75] Inventors: Boris G. Traktovenko, Avon; Peter O. Erlandsen, Glastonbury, both of Conn.

[73] Assignee: Otis Elevator Company, Farmington, Conn.

[21] Appl. No.: 08/996,942

[22] Filed: Dec. 23, 1997

[51] Int. Cl.[6] ..... B66B 7/00

[52] U.S. Cl. ..... 187/414; 187/411

[58] Field of Search ..... 187/251, 411, 187/412, 414; 414/744.5; 901/18

[56] References Cited

U.S. PATENT DOCUMENTS

| | | | |
|---|---|---|---|
| 134,179 | 12/1872 | Whittier | 187/411 |
| 3,991,856 | 11/1976 | Shigata et al | 187/414 X |
| 4,117,908 | 10/1978 | Nara et al. | 187/411 X |
| 4,668,155 | 5/1987 | Kaufmann et al. | 901/18 X |
| 5,103,937 | 4/1992 | Robertson | 187/251 X |

*Primary Examiner*—William E. Terrell
*Assistant Examiner*—Gene O. Crawford

[57] ABSTRACT

An apparatus is provided for preventing sway of elevator ropes (7). The apparatus comprises a swing arm (2) positioned within a hoistway (6) of an elevator. The swing arm is movable between a first position and a second position wherein the swing arm is in proximity with the ropes in the first position and the ropes contact the swing arm thereby reducing sway and wherein the swing arm is positioned outside of the path of an elevator car (8) in a second position. An embodiment includes a sheath (21) having tapered ends (22, 23) mounted to the end of the swing arm to facilitate the movement of the swing arm through the plurality of ropes.

12 Claims, 6 Drawing Sheets

SWING ARM TO PREVENT SWAY OF ELEVATOR ROPES

TECHNICAL FIELD

This invention relates to elevator ropes and cables and more specifically, this invention relates to a device which reduces elevator rope and cable sway.

BACKGROUND ART

The problem of elevator rope and cable sway is well known in the art. In tall buildings elevator ropes and cables, which include hoist ropes, compensation ropes, governor ropes, and traveling cables, are known to vibrate in sympathy with the wind induced sway of the building and other dynamic factors affecting the building. The swaying of the ropes causes many problems chief among them is increased fatigue and wear, excessive noise, and the increased possibility of tangling.

Numerous attempts have been made in the industry to reduce or eliminate elevator rope sway and its detrimental effects on elevator usage. For instance, elevator motion control systems have been employed to control elevator car movement such as inhibiting the dispatching of an elevator car if rope sway is determined to be excessive, prohibiting elevator cars from parking on floors that would enhance sway, reducing elevator car speed when excessive rope sway is detected, and maintaining elevator cars in continues motion to prevent excessive sway conditions. Since elevator hoistway space detracts from useful building space the hoistway dimensions are typically quite small and any attempt at reducing rope sway must fit within a relatively small area.

In another approach, a follower car is positioned below an elevator car and travels along with the elevator car at half the distance between the car and the pit. The follower car effectively creates a node at the midpoint and reduces rope sway. Some of the problems with employing a follower car are that it is relatively expensive, increases the load on the elevator drive machine and hoist ropes, is ineffective for hoist rope swag and also requires an increased pit depth.

In still other approaches guides or poles are placed within the shaft to limit the sway of the ropes. One such approach is disclosed in U.S. Pat. No. 5,103,937 ('937). The '937 patent teaches the use of an oscillation limiting member which mounts to a wall of an elevator hoistway an extends into the hoistway to contact the ropes and thereby limit rope sway. One problem with the apparatus taught in the '937 patent is that the solid members project perpendicular from the walls of the hoistway and must be mounted near the center of the hoistway to be placed proximate the ropes in an extended position. As such the apparatus would interfere with side rails, counter balance weights and rails, as well as other elevator equipment positioned near the center of most elevator hoistway walls. In addition, in the event of a collision between an elevator car and an apparatus as disclosed in the '937 patent the apparatus would break free from the mount and fall to the bottom of the hoistway causing possible structural damage. Another problem with the apparatus disclosed in the '937 patent is that the solid members are heavy and cantilevered from the wall and as such a large amount of torque is required from the actuator to reliably extend and retract the member. This requires a large actuator which may require a larger space than most hoistways allow. The cable members disclosed within the '937 patent also require more space than is typically available in elevator hoistways and are restricted from installation in those quadrants of the hoistway which may be occupied by the governor rope, traveling cables, selector tape, etc.

The rope sway limiting devices of the '937 patent as well as most other devices of the prior art also have the disadvantage of being incapable of retrofit into existing elevator installations. As such there is a need for a reliable and effective device to reduce elevator rope sway which eliminates or reduces the problems of the prior art.

DISCLOSURE OF INVENTION

Therefore, it is an object of the present invention to provide a method and apparatus for preventing sway of elevator ropes. It is a further object of the present invention to provide a support mechanism and control method for positioning a swing arm in proximity with a set of elevator ropes to effectively reduce the sway thereof.

The foregoing and other objects, features and advantages of the present invention will become more apparent in light of the following detailed description of the invention, as shown in the accompanying drawings.

BEST MODE FOR CARRYING OUT THE INVENTION

Figure 1:
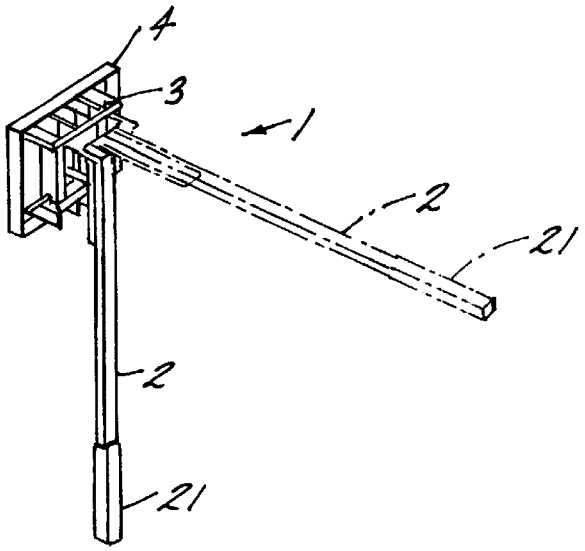
FIG. 1 is an isometric view of a swing arm assembly in accordance with the present invention.
Figure 2:
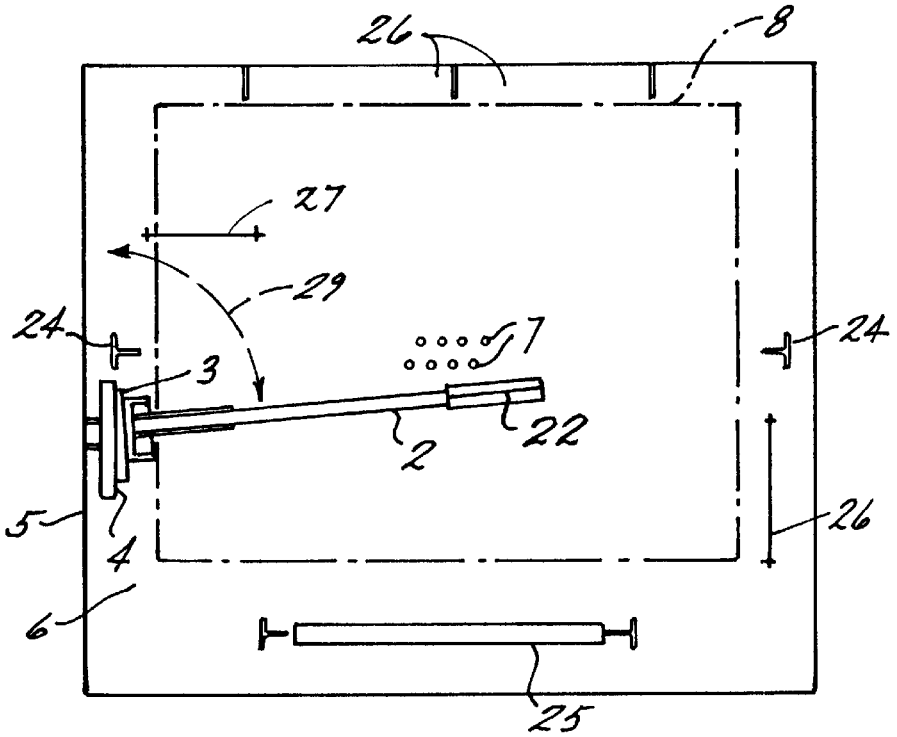
FIG. 2 is a plan view of a swing arm assembly installed in a hoistway of an elevator.

Referring to FIG. 1 an embodiment of a swing arm assembly is shown generally at 1 in a retracted position. Swing arm assembly 1 includes swing arm 2 mounted to actuation assembly 3 and frame 4. Swing arm 2 is shown in phantom in FIG. 1 in the extended position. Referring now to FIG. 2 swing arm assembly 1 is shown installed to wall 5 of elevator hoistway 6 with swing arm in the extended position in proximity to elevator ropes 7. Swing arm assembly 1 is mounted away from the center of wall 5 so as not to interfere with guide rails 24, counterweight assembly 25 and other cables 26, 27 and door assembly 28 and as such frame 4 positions swing arm 2 at an oblique angle relative to wall 5 indicated by arrow 29. Angle 29 is adjustable within frame 4 to accommodate different hoistway sizes and equipment configurations. The footprint of an elevator car is represented by 8 and as can be seen in the Figure swing arm assembly 1 is located outside of the footprint of the elevator car allowing the car to pass unobstructed when the swing arm is in the retracted position. In operation swing arm assembly 1 is positioned along the shaft of an elevator hoistway at predetermined locations (not shown) in a similar manner to that shown in FIG. 2 such that as the ropes 7 begin to sway the amplitude of oscillation is limited by contact with swing arm 2.

Figure 3:
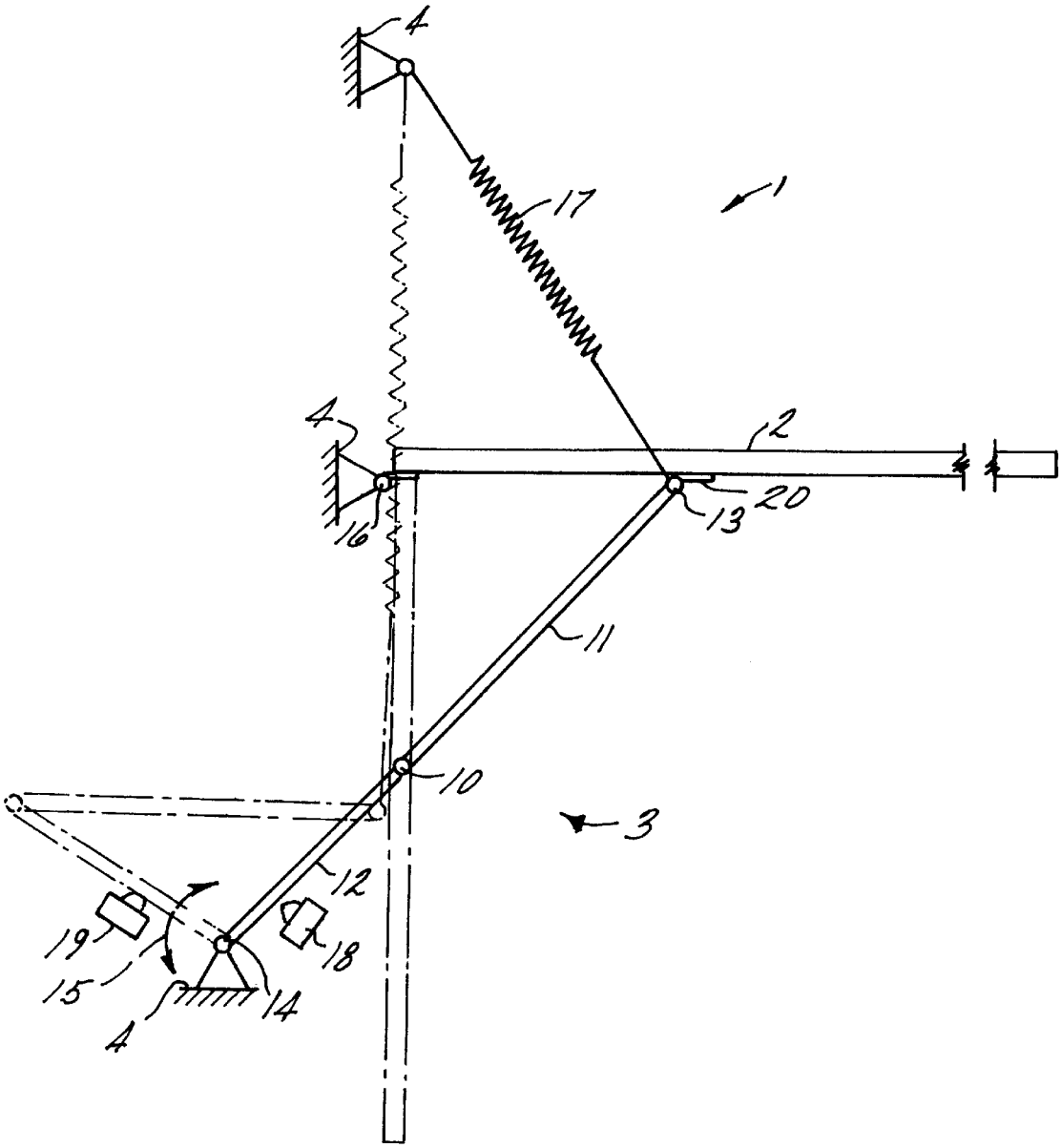
FIG. 3 is a kinematic representation of a swing arm assembly showing an actuation system and limit switches.

Referring to FIG. 3 there is shown a kinematic depiction of swing arm assembly 1 in an extended position. Actuation assembly 3 is comprised of linkage 9 including a hinge 10 joining link bars 11, 12 which are attached to swing arm 2 by a hinge 13 and to axle 14 respectively. Also included in actuation assembly 3 is an actuator represented by arrow 15 which rotates axle 14 in a clockwise direction as viewed in FIG. 3 to position swing arm 2 in an extended position and further rotates in a counterclockwise direction to position swing arm 2 in a retracted position as indicated in phantom in FIG. 3. Actuator 15 is preferably comprised of an electric motor but may also advantageously comprise a hydraulic actuator, or a pneumatic actuator. It is important to note that the linkage 3 is arranged such that the ratio of the moment around about pivot 16 applied by the weight of the swing arm 2 decreases as the arm moves toward the horizontal position which reduces the torque requirements of actuator 15 and reduces overall wear and tear on the actuation system. In an alternative embodiment spring 17 is attached between swing arm 2 and frame 4 to assist in further reducing the torque requirement of actuator 15 during the positioning of the sway rod in the extended position. It is meaningful to note that link bars 11 and 12 become collinear when sway bar 2 reaches the fully extended position which works to effectively lock the actuation assembly in place and thereby relieves the torque requirement of actuator 15 from maintaining the sway bar in the extended position.

Figure 4:
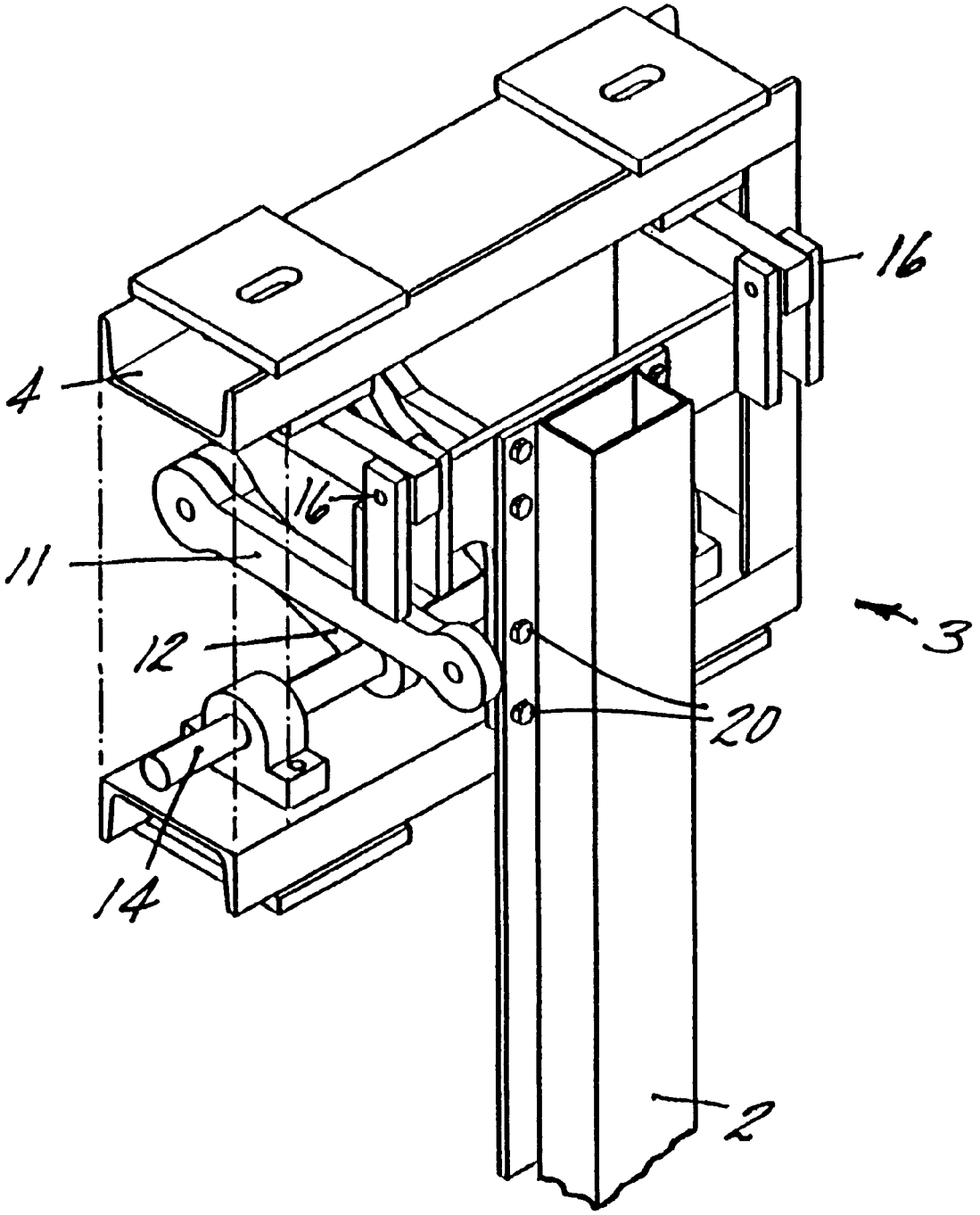
FIG. 4 is an isometric view of an embodiment of a swing arm assembly in a retracted position.
Figure 5:
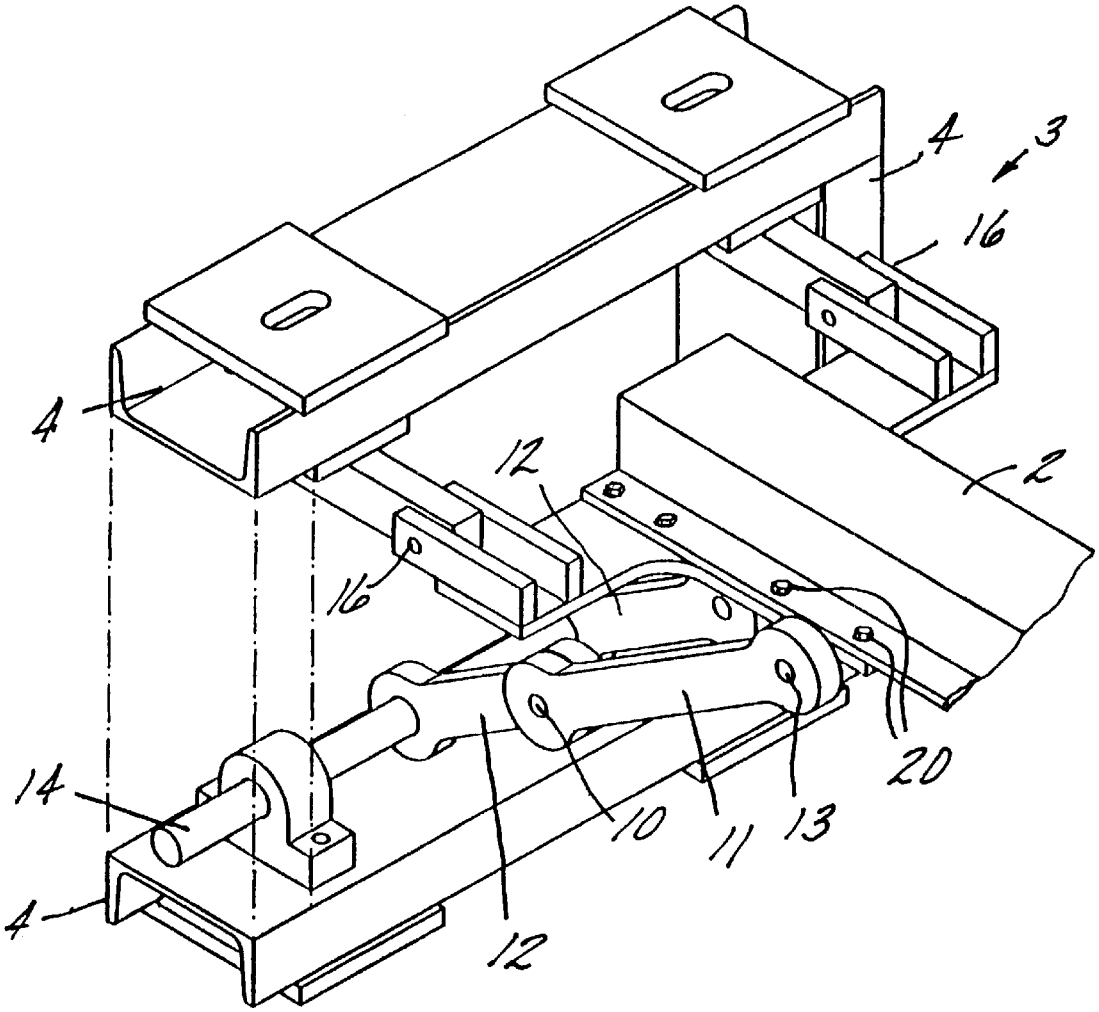
FIG. 5 is an isometric view of an embodiment of a swing arm assembly in an extended position.

Now with reference to FIGS. 4 and 5 there is shown an embodiment of the actuation assembly 3 including swing arm 2 as described herein above for FIG. 3. FIG. 4 depicts swing arm 2 in the retracted position and FIG. 5 shows swing arm 2 in an extended position. Note that the cross section of swing arm 2 is rectangular to provide a maximum stiffness perpendicular to the direction of rope sway. In a preferred embodiment of the present invention breakaway bolts 20 or hinge 13 at the attachment of link bar 11 and swing arm 2 are sized to provide a mechanical fuse. In the unlikely event of a collision between the car and the swing arm the bolts are sheared and the link bars 11, 12 and swing arm 2 swing safely against the wall 5 of the hoistway 6.

In operation an elevator motor controller (not shown) controls the movement of the elevator car within the hoistway as well as the actuator 15 of the swing arm assembly 1. The controller enables the actuator to extend the swing arm when the car is stopped at a floor where the ropes are determined to sway, and further enables the actuator to retract the swing arm when the car is moving within the hoistway. With reference back to FIG. 3 an embodiment of the present invention further includes limit switches 18, 19 to provide a signal to the elevator motor controller corresponding to the position of the swing arm 2. It is contemplated by the present invention that the motor controller would prevent the motion of the elevator car while the swing arm is in the extended position and therefor reduces the possibility of collision between the car and the swing arm. Limit switches 18, 19 are contact type switches in a preferred embodiment however any type of sensor with the requisite accuracy and reliability of properly communicating the position of the swing arm is contemplated.

Figure 6:
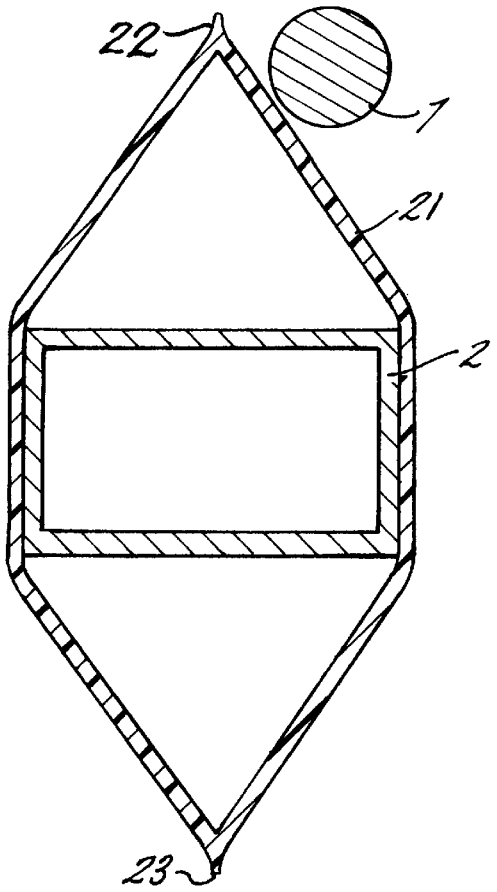
FIG. 6 is a cross sectional view of a swing arm showing a sheath.

Now with reference to FIG. 6 there is shown a section view of an outboard end of swing arm 2 including sheath 21. Sheath 21 is provided in an embodiment of the present invention to reduce the force required to extend end retract the swing arm within the group of ropes 7. In operation as the swing arm 2 is actuated into the extended position point 22 of sheath 21 contacts the ropes 7 and are displaced to either side of swing arm 2. When swing arm 2 is retracted point end 23 contacts the ropes which are displaced to the sides of swing arm 2 to the force required to retract the arm. An advantage of an embodiment of the present invention employing sheath 21 is that the swing arm 2 may be plowed through the ropes without regard to the position of the ropes at the moment of extension. In a preferred embodiment sheath 21 is comprised of a pair of plastic sheets having a low coefficient of friction bonded together at point ends 22, 23 and releasably attached swing arm 2. The employment of the sheath also reduces wear on the ropes and is easily replaced during routine elevator maintenance. Although the shape shown is a preferred configuration other shapes are contemplated by the present invention as well as a shape that is formed integral to the swing arm 2 itself.

Figure 7:
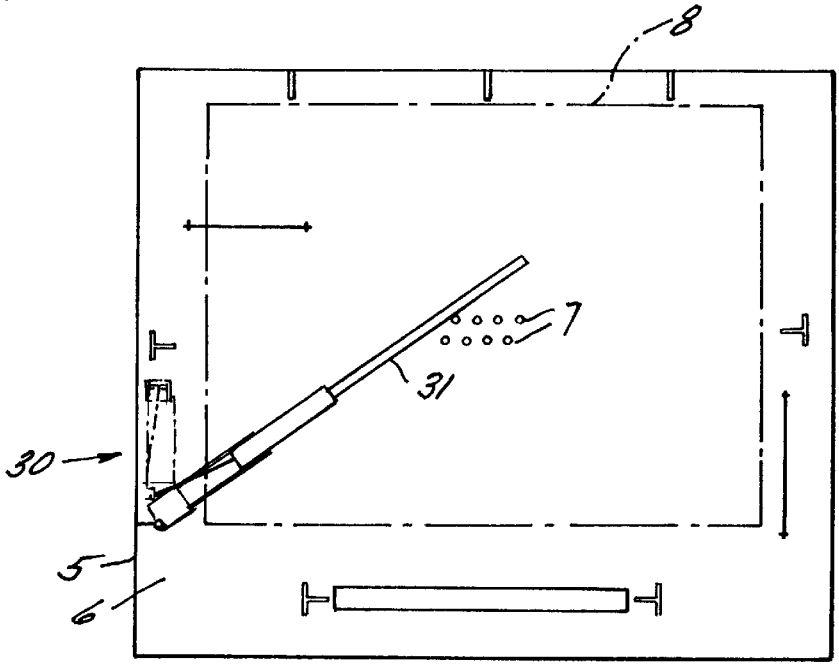
FIG. 7 is a plan view of an embodiment of a horizontal swing arm positioned within a hoistway of an elevator.
Figure 8:
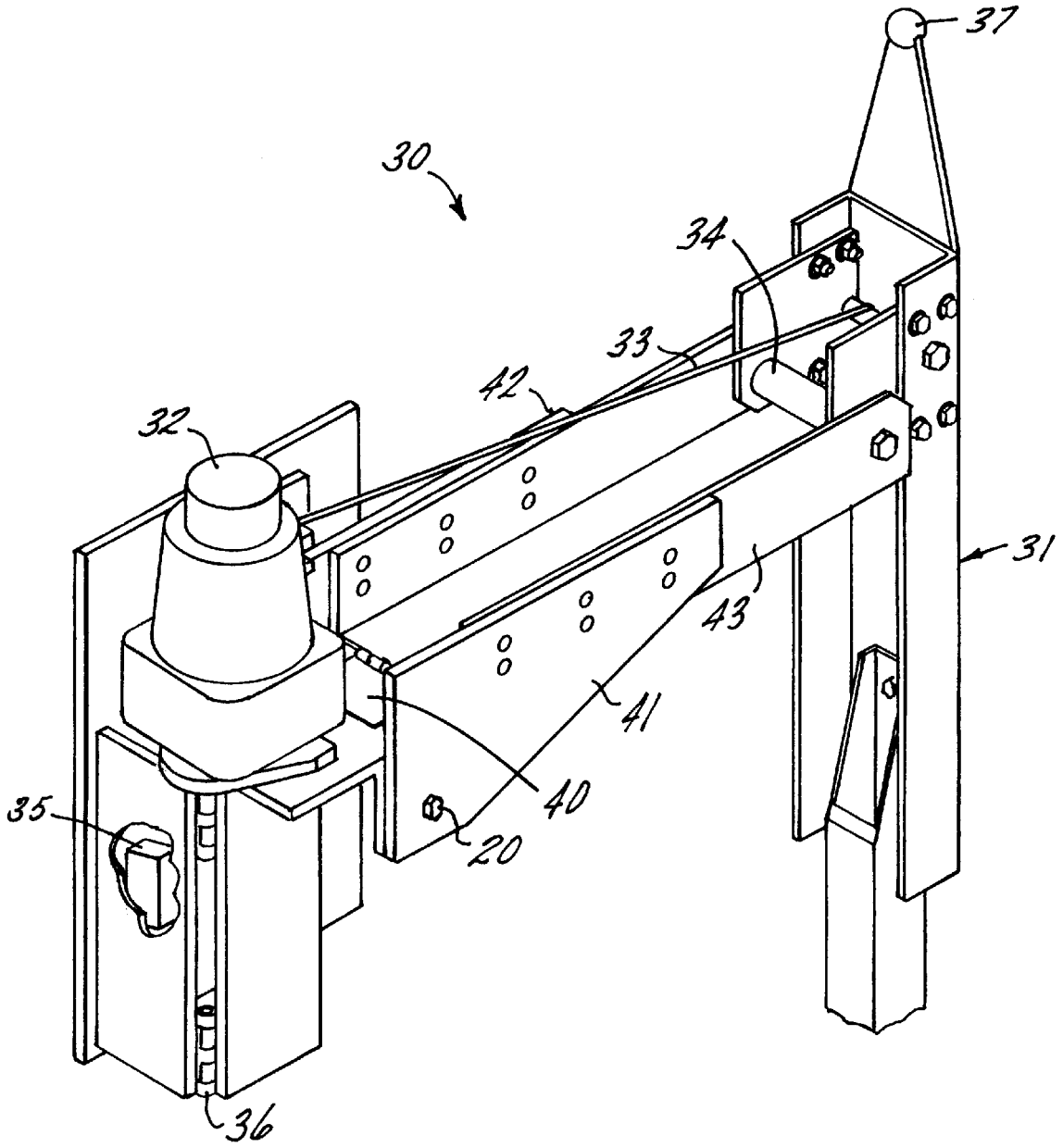
FIG. 8 is a partial isometric view of an embodiment of a horizontal swing arm showing an actuation assembly.

Another embodiment of the present invention in FIGS. 7 and 8 is shown generally as horizontal swing arm assembly 30. With reference to FIG. 7 horizontal swing arm assembly 30 is shown in phantom attached to wall 5 of hoistway 6 in a retracted position outside of the footprint of elevator car 8. Swing arm assembly 30 is shown in solid with swing arm 31 in an extended position in proximity to ropes 7 to prevent sway thereof. With reference to FIG. 8 horizontal swing arm assembly 30 is controlled in the manner described herein above for swing arm assembly 1 and includes a rotary motor 32 which rotates horizontal swing arm 43 about hinge 35 and in so doing the effective length of cable 33 attached to swing arm 31 is shortened causing swing arm 31 to pivot into a horizontal position about pivot 34 and further rotates swing arm 31 about hinge 36 away from wall 5 into hoistway 6 and within proximity of ropes 7 and rotary motor 32 separately retracts cable 33 to position horizontal swing arm 31 away from wall 5. In an alternative embodiment, horizontal swing arm assembly 30 further includes rotary actuator 35 which rotates swing arm 31 about hinge 36 away from wall 5 into hoistway 6 in proximity with ropes 7. Also included in the embodiment shown is counterweight 37 which reduces the torque required from rotary motor 32 to raise and maintain swing arm 31 in a horizontal position. The horizontal swing arm assembly 30 is articulated into a retracted position by reversing rotary motor 32 and releasing cable 33 and reversing rotary actuator 35 to pivot swing arm 31 against wall 5. The operation of rotary motor 32 and rotary actuator 35 may be simultaneous or rotary motor 32 may be operated prior to rotary actuator 35. An advantage of the horizontal swing arm assemble over the prior art, in addition to those advantages described herein above for swing arm assembly 1, is that the swing arm is extended and retracted outside of the proximity of the ropes thereby reducing the occurrence of tangling within the ropes during extension or retraction.

Still with reference to FIG. 8, breakaway bolts 20 and hinge 40 are provided in attaching gussets 41, 42 and horizontal arm 43 to platform 44. In the unlikely event of a collision between an elevator car (not shown) and the horizontal swing arm in the extended position breakaway bolts 20 provide a mechanical fuse to allow the swing arm to pivot about hinge 40 and out of the way of the moving car.

While preferred embodiments have been shown and described, various modifications and substitutions may be made thereto without departing from the spirit and scope of the invention. Accordingly, it is to be understood that the present invention has been described by way of illustrations and not limitation.

We claim:

1. A device, for limiting sway of a plurality of ropes vertically disposed in a hoistway to support an elevator car, said hoistway containing vertically oriented, spaced-apart guide rails between which said elevator car moves vertically, said device comprising:

a base disposed on a wall of said hoistway a first horizontal distance from one of said guide rails;

a pivot having an axis, said pivot disposed on said base with its axis at the intersection of a first, substantially horizontal plane with a second, vertical plane that bears a small acute angle with respect to a third, vertical plane that is normal to a fourth, vertical plane extending between said guide rails;

a swing arm having a proximal end disposed to rotate about said pivot between a rest position in which said swing arm extends substantially vertically from said base and an operative position in which said swing arm extends substantially horizontally from said base with a distal end thereof disposed a second horizontal distance from said fourth plane which is substantially less than said first horizontal distance; and an actuator for moving said swing arm between said rest position and said operative position.

2. The device as set forth in claim 1 wherein said swing arm includes a sheath disposed at a distal end, said sheath having a pair of tapered ends positioned perpendicular to a pair of substantially flat parallel sides, said sheath positioned such that said sides are parallel with said ropes in said operative position and said tapered ends are generally vertically aligned with said ropes in said rest position to facilitate positioning said swing arm within said ropes.

3. The device as set forth in claim 1 wherein:

said actuator is a rotary actuator; and further comprising:

a shaft mounted to said rotary actuator;

at least one first link bar attached to said shaft;

at least one second link bar pivotally attached to each said at least one first link bar and said swing arm wherein said first link bar and said second link bar are collinear in said operative position thereby locking said swing bar in said operative position.

4. The device as set forth in claim 1 wherein said swing arm includes a sheath disposed at a distal end, said sheath having a pair of tapered ends positioned perpendicular to a pair of substantially flat parallel sides, said sheath positioned such that said sides are parallel with said ropes in said operative position and said tapered ends are generally vertically aligned with said ropes in said rest position to facilitate positioning said swing arm within said ropes.

5. The device as set forth in claim 1 further comprising at least one breakaway fastener for attachment of each of said at least one second link bar to said swing arm to provide for failure of said attachment when said car contacts said swing bar.

6. The device as set forth in claim 1 further comprising a spring mounted to said wall and said swing arm to bias said swing arm toward said operative position.

7. The device as set forth in claim 1 further comprising at a motion controller circuit controlling the movement of said car and controlling said actuator.

8. The device as set forth in claim 7 further comprising at least one sensing device connected to said motion controller circuit producing an output signal corresponding to either said rest position or said operative position.

9. A system comprising a plurality of devices, each for limiting sway of a plurality of ropes vertically disposed in a hoistway to support an elevator car, said hoistway containing vertically oriented, spaced-apart guide rails between which said elevator car moves vertically, each of said devices comprising:

a base disposed on a wall of said hoistway a first horizontal distance from one of said guide rails;

a pivot having an axis, said pivot disposed on said base with its axis at the intersection of a first, substantially horizontal plane with a second, vertical plane that bears a small acute angle with respect to a third, vertical plane that is normal to a fourth, vertical plane extending between said guide rails;

a swing arm having a proximal end disposed to rotate about said pivot between a rest position in which said swing arm extends substantially vertically from said base and an operative position in which said swing arm extends substantially horizontally from said base with a distal end thereof disposed a second horizontal distance from said fourth plane which is substantially less than said first horizontal distance; and an actuator for moving said swing arm between said rest position and said operative position; and wherein said plurality of devices are distributed vertically along said hoistway.

10. The system as set forth in claim 9 further comprising a motion controller circuit controlling the movement of said car and controlling each of said actuators.

11. The system as set forth in claim 9 further comprising at least one sensing device connected to said motion controller circuit for producing an output signal corresponding to either said rest position or said operative position of each of said swing arms.

12. The system set forth in claim 9 wherein each of said swing arms includes a sheath disposed at a distal end, each of said sheaths having a pair of substantially flat parallel sides and a pair of tapered ends positioned perpendicular to said sides, said sheath positioned such that said sides are parallel to said ropes in said operative position and said tapered ends are generally vertically aligned with said ropes in said rest position to facilitate positioning said swing arm within said ropes.

* * * * *